United States Patent [19]

Adams

[11] Patent Number: 4,643,426

[45] Date of Patent: Feb. 17, 1987

[54] GAME PLAYING IMPLEMENT

[76] Inventor: Daniel Adams, 345 W. Packard, Fort Wayne, Ind. 46807

[21] Appl. No.: 769,410

[22] Filed: Aug. 26, 1985

[51] Int. Cl.[4] ..... A63F 9/00; B43K 29/00

[52] U.S. Cl. ..... 273/148 R; 294/65.5; 401/195

[58] Field of Search ..... 273/148 R, 239, 240; 294/65.5; 401/195

[56] References Cited

U.S. PATENT DOCUMENTS 1,255,671 2/1918 Vaughn et al. ..... 401/195
2,385,859 10/1945 Jacobson ..... 294/65.5 UX
3,436,163 4/1969 Calabrese et al. ..... 273/148 R X
4,019,747 4/1977 Chuilli ..... 273/239
4,172,597 10/1979 Smith et al. ..... 273/148 R X

*Primary Examiner*—Anton O. Oechsle
*Attorney, Agent, or Firm*—Roger M. Rickert

[57] ABSTRACT

A dual purpose game playing magnetic wand has one end thereof formed as a magnetized extension for selectively removing ferromagnetic game pieces from a playing board while the handle or other end of the wand is hollow having a wick and marking fluid therein to be used for permanently marking a game playing board when desired.

2 Claims, 4 Drawing Figures

GAME PLAYING IMPLEMENT

SUMMARY OF THE INVENTION

The present invention relates generally to an implement employed in playing a game and more particularly to such an implement used to mark or to clear a game playing card.

There are a number of games of which Bingo is the most widely known example wherein a game card having a matrix of game playing indicia thereon is selectively marked in some way as the game progresses with the object of the game being to complete the marking of some specified pattern on the game card. A typical Bingo card displays a five by five array of numbers and in a simple form markers such as kernels of corn have been used to mark individual numbers as they are called by simply placing the kernel of corn on that number and proceeding, for example, until a row, column or diagonal of five such kernels appear on the card indicating the end of a game.

More sophisticated Bingo cards have been devised where individual colored transparent slides may be moved to change the coloring of individual numbers on the card as those numbers are called. Wooden discs or chips have also been placed over numbers as called and in each of these schemes the card is somehow cleared at game end preparatory to a new game.

A recent scheme for clearing a Bingo card is disclosed in U.S. Pat. No. 3,684,288, wherein marking chips of a ferromagnetic nature are placed on the card as individual numbers are called and at game end a magnetic wand is passed over the game card to pick up the individual chips which may be then stripped from the wand by hand into a container preparatory to the beginning of a new game. Magnetic wands and ferromagnetic chips have found wide acceptance in the game of Bingo.

In other forms or modes of play of games such as Bingo, the game card is dedicated in the sense that individual numbers as called are permanently marked in some manner on the game card and at game end the card is discarded and a new game begins with each player having a fresh game card. One scheme that has found wide acceptance in this mode of play is the so-called dauber wherein a container of a marking fluid such as colored water, hereinafter generically "ink", has a sponge rubber or felt-like wick so that the bottle may be inverted and the wick touched against the card at the number called leaving a circle of ink permanently marking that number. Such daubers have a screw closure cap and are typically carried to and from Bingo game sites by players.

Thus the avid Bingo player may carry to and from a game site a variety of game playing paraphenalia including a magnetic wand such as described in the aforementioned U.S. Pat. No. 3,684,288, as well as a dauber preparatory to an evening's play. It would be highly desirable to reduce the number of separate items carried or used by a Bingo player.

U.S. Pat. No. 3,436,163 represents an attempt to combine Bingo game marking arrangements into a single structure. In this patented arrangement, an elongated cylinder has one end thereof formed as a dauber for permanently marking Bingo playing cards while the other end thereof receives a stack of Bingo card marking chips to be dispensed therefrom one at a time during play. Either due to excessive cost or the time and trouble required to load individual chips into the dispenser, this patented arrangement has not met with widespread commercial success.

Among the several objects of the present invention may be noted the provision of a dual purpose game playing implement which facilitates the playing of a Bingo type game in either a dedicated card or a reusable card mode of play; the provision of a magnetic wand for collecting ferromagnetic playing pieces at the conclusion of a game; the provision of a marking fluid dispensing device for permanently marking a game card; the provision of a game playing device incorporating each of the last two mentioned features into a single structure; and the provision of an improved screw cap arrangement for an ink dispensing game card marking bottle having a screw cap at one end thereof for sealing the bottle and having a magnetized extension at the other end thereof so that the bottle and extension when joined may be employed as a magnetic wand for removing magnetized playing pieces from a game board. These as well as other objects and advantageous features of the present invention will be in part apparent and in part pointed out hereinafter.

In general an improved screw cap for a card marking bottle has an internally threaded concavity at one end which concavity threadedly engages a correspondingly threaded ink dispensing end of the bottle and an elongated body portion extending away from the concave one end including a permanent magnet structure within that body portion. Typically the body portion comprises a thin walled plastic shell completely encasing a molded plastic magnet.

Also in general and in one form of the invention, a magnetic wand for collecting multiple ferromagnetic playing pieces at the end of a game has a hollow handle portion and a permanently magnetized extension portion extending away from the handle portion. The handle portion includes a marking fluid dispensing wick and a closure arrangement for selectively covering the wick. The handle portion is adapted to receive an ink supply and to dispense that ink through the wick for permanently marking a game card, if desired.

Still further in general and in one form of the invention, a dual purpose game playing implement has an elongated generally cylindrical marking fluid container with a screw cap coverable fluid dispensing wick at one end and an elongated generally rectangular plastic shell blending toward one end thereof into a generally cylindrical threaded cap for covering the fluid dispensing wick. The shell contains a permanent magnet so that the implement may be employed either for clearing ferromagnetic playing pieces from a playing card or permanently marking such a playing card with ink from the fluid dispensing wick.

BRIEF DESCRIPTION OF THE DRAWINGS

Corresponding reference characters indicate corresponding parts throughout the several views of the drawings.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
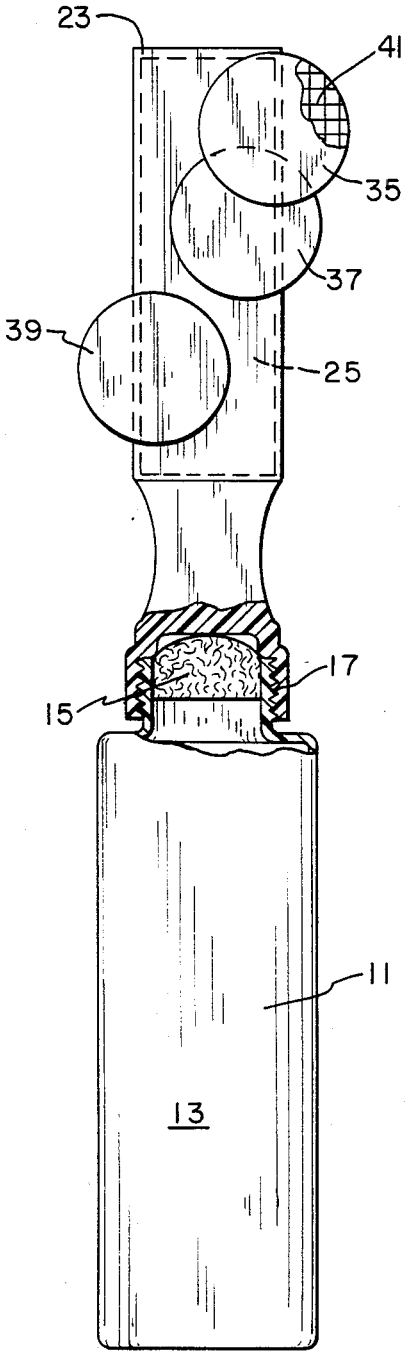
FIG. 1 is a partially cutaway side view of a magnetic wand in one form of the invention illustrating several playing pieces captured thereon.
Figure 2:
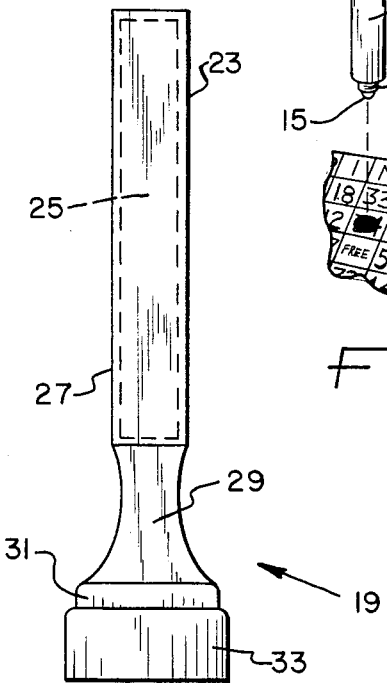
FIG. 2 is a side view of the cap and magnetized extension portion of the wand of FIG. 1 from the right side thereof.
Figure 4:
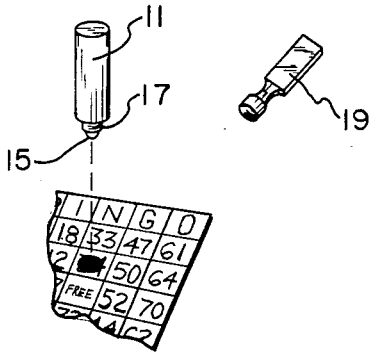
FIG. 4 is a partial perspective view illustrating use of the handle portion of the wand in permanently marking a playing card.
Figure 3:
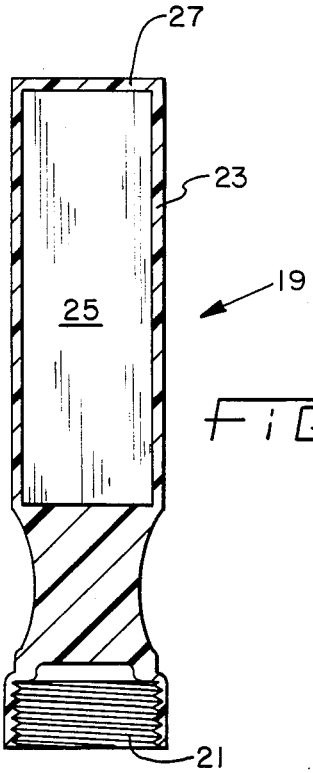
FIG. 3 is a view in cross-section of the extension portion and cap of FIGS. 1 and 2.

Referring to FIGS. 1 and 4, handle portion 11 of the magnetic wand may be a commerically available dauber for marking Bingo cards. Such daubers are frequently in the form of a plastic bottle for receiving an ink supply in the region 13 and having a marking fluid dispensing wick 15 near one end. The wick is surrounded by threads 17 at the ink dispensing end of the bottle and is typically commercially supplied with a simple end closing cap which screws onto threads 17 sealing the bottle for transportation or storage. Thus threads 17 form a threaded cap receiving region circumferentially surround wick 15. In use for permanently marking a game playing card, the container or handle portion is simply inverted and the sponge rubber or felt wick 15 pressed against the playing card, as for example illustrated in FIG. 4, to mark the rectangle identified as "N34".

Rather than the conventional end sealing cap, the present invention provides an improved screw cap 19 having an internally threaded concavity 21 with the internal threads thereof adapted to mate with the correspondingly threaded ink dispensing end 17 of the bottle to form an end closure for that bottle. The improved screw cap 19 also includes an elongated body portion 23 having a permanent magnet 25 completely encased in a thin walled plastic shell 27. The plastic shell 27 as well as the permanent magnet 25 are both of a generally rectangular cross-sectional configuration and the plastic shell 27 blends in a blend region 29 into a generally cylindrical cross-sectional configuration 31 which defines the outer portions of the cap 33 at one end thereof. When joined, as illustrated in FIG. 1, the dauber 11 provides a handle for the magnetized extension portion 23 so that the magnetic wand may be passed over a game playing card partially covered with ferromagnetic chips with chips 35, 37 and 39 illustrated in FIG. 1 as having been picked up by that wand. Such magnetic chips are commerically available and in one form are molded plastic encasing an iron screen 41. Both the plastic encasing of the chips such as 35, 37 and 39 and the shell 27 of the magnetic wand are relatively thin and do not reduce the magnetic force of attraction between the chips and the wand to any serious extent.

Thus the magnetic wand of the present invention is a dual purpose game playing implement in that in one mode of play ferromagnetic playing pieces are selectively positioned on a game board as the game progresses and all are easily removed at the end of the game by passing the wand over the board attracting those playing pieces to the wand as illustrated in FIG. 1. In another mode of play the improved cap 19 is removed and a relatively permanent game record is achieved by daubing the game card much as illustrated in FIG. 4. A player cannot effectively sweep the board clear without having the handle 11 joined to the magnetic extension portion 23, nor can the player safely carry the daubing bottle handle 11 to or from a playing site without its cap 19 and included magnet positioned thereon.

From the foregoing it is now apparent that a novel dual purpose game playing implement has been disclosed meeting the objects and advantageous features set out hereinbefore as well as others and that modifications will readily suggest themselves to those of ordinary skill in the art. For example, from an economics and convenience point of view, a conventional ink dispensing dauber has been illustrated in conjunction with an improved screw cap therefor. However, the handle and magnetic extension portions might be permanently joined with the handle hollow and sealed except for a dauber end, for example at the base of the handle with the wick thereof covered by a conventional cap. Such an arrangement would need periodic refilling with ink or other colored marking fluid. Also the permanent magnet 25 preferably of a molded plastic variety has been illustrated as completely encased within the thin plastic shell 27. However, other types of permanent magnet might be employed and in some cases the magnet gripped in a manner other than completely encasing it within the shell. These as well as numerous other modifications will readily suggest themselves to those of ordinary skill in the art and such modifications may be made without departing from the spirit of the invention or the scope thereof as set out by the claims which follow.

What is claimed is:

1. A magnetic wand for collecting a plurality of ferromagnetic playing pieces previously temporarily positioned on a game card in one mode of play, the wand having a hollow handle portion and a permanently magnetized extension portion comprising a permanent magnet structure and a thin walled plastic shell completely encasing the permanent magnet structure extending from the handle portion, the handle portion including a marking fluid dispensing wick and closure means comprising a threaded coupling between the handle portion and the extension portion for selectively covering the wick with the extension portion by threadedly joining the extension portion to the handle portion, the handle portion adapted to receive an ink supply and to dispense that ink through the wick for permanently marking a game card in another mode of play, a game player using the handle portion only in said another mode of play while using both the handle portion and the extension portion coupled together to clear the game card at the conclusion of play in said one mode of play.

2. An improved screw cap for an ink dispensing game card marking bottle having an internally threaded concavity at one end thereof with internal threads adapted to mate with a correspondingly threaded ink dispensing end of a bottle to form an end closure for that bottle and an elongated body portion including a permanent magnet structure, the body portion comprising a thin walled elongated plastic shell of generally rectangular cross-sectional configuration completely encasing the permanent magnet structure and blending toward one end thereof into a generally cylindrical cross-sectional configuration in the region of said internally threaded concavity defining said end closure at said one end.

* * * * *